US007146792B2

(12) United States Patent
Badiali et al.

(10) Patent No.: US 7,146,792 B2
(45) Date of Patent: Dec. 12, 2006

(54) SERVICE TROLLEY FOR OPEN-END SPINNING MACHINES

(75) Inventors: Roberto Badiali, Pordenone (IT); Vittorio Colussi, Cappella Maggiore (IT); Donato Castellarin, Azzano Decimo (IT)

(73) Assignee: Savio Macchine Tessili S.p.A, Pordenone (IT)

( * ) Notice: Subject to any disclaimer, the term of this patent is extended or adjusted under 35 U.S.C. 154(b) by 0 days.

(21) Appl. No.: 10/963,685

(22) Filed: Oct. 13, 2004

(65) Prior Publication Data

US 2005/0081506 A1 Apr. 21, 2005

(30) Foreign Application Priority Data

Oct. 16, 2003 (IT) ..... MI2003A2005

(51) Int. Cl.
*B65H 69/06* (2006.01)

(52) U.S. Cl. ..... 57/22; 57/263

(58) Field of Classification Search ..... 57/22, 57/263, 276; 700/139
See application file for complete search history.

(56) References Cited

U.S. PATENT DOCUMENTS 4,821,504 A * 4/1989 Shinkai et al. ..... 57/276
5,293,738 A * 3/1994 Ferro et al. ..... 57/261
5,778,651 A 7/1998 Spindler et al.
6,014,592 A * 1/2000 Fechter et al. ..... 700/130
6,574,526 B1 * 6/2003 Gaukler et al. ..... 700/139
2003/0029154 A1 * 2/2003 Straaten ..... 57/279
2003/0056487 A1 * 3/2003 Zipperer ..... 57/264

FOREIGN PATENT DOCUMENTS

DE 42 23 956 A1 4/1993
EP 0 337 339 A 10/1989

OTHER PUBLICATIONS

European Search Report, Apr. 25, 2006.

* cited by examiner

*Primary Examiner*—Shaun R. Hurley
(74) *Attorney, Agent, or Firm*—James V. Costigan; Hedman & Costigan

(57) ABSTRACT

Service trolley for open-end spinning machines equipped with members dedicated to the operations in the intervention cycles and managed by the trolley's own control unit in which each member is independent from the others, being equipped with independent actuation controlled by sensors for the various steps of the intervention cycles.

8 Claims, 2 Drawing Sheets

SERVICE TROLLEY FOR OPEN-END SPINNING MACHINES

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION (1) Field of the Invention

The present invention refers to open end spinning, or rotor spinning. Open-end spinning machines generally consist of a plurality of individual spinning units, aligned on the two sides of the machine, each of which is made up of a spinning rotor, which produces twisted tread from singularised fibres of a rove, and a collection unit that—with the prior quality control of yarn with the interposition of a yarn clearer between the two components—carries the yarn to wind onto a quill to form a cone. This cone is thus formed pulling and winding the yarn on its surface, being pulled into rotation by the roller below on which the cone in formation is rested. The yarn is wound in a spiral on the cone in rotation since the collection unit is equipped with a thread-guiding device that distributes the yarn on the outer surface of the cone with to and fro axial motion.

The structure of the individual spinning station is illustrated in the scheme of FIG. 1, and its operation according to its normal running is briefly described hereafter.

Proceeding from the bottom towards the top, the spinning station 1 consists of the actual spinning unit 2 and the collection unit 3, the main components of which that lead to the transformation of the rove of fibres made to run parallel in the cone of wound yarn are briefly illustrated hereafter.

The supply band or rove S is contained in a cylindrical vessel 4 where it is deposited in a double spiral. The rove S is supplied to the unit by a supply roller 5 passing through the funnel-shaped conveyor 6 and reaches the card 7, a rotating roller equipped with a toothed trimming that singularises the fibres of the rove S and conveys them by suction to the spinning rotor 8, which works in a vacuum.

In the spinning rotor 8, which rotates at very high speeds (up to 150,000 revs/minute and beyond), the singularised fibres are deposited in its peripheral throat by centrifugal effect; from here they are collected and picked up in the form of thread F, coming out axially from its central opening 9, receiving the twists from the rotation of the rotor itself in the path that runs between its inner throat and such an opening 9, thus generating the twisted thread F.

The pulling back of the thread is carried out with a pair of opposite extraction cylinders 11 and 12 for gripping the thread F and actuated at a controlled speed according to the arrow a, thus determining the linear production of yarn, generally indicated in m/min. The yarn clearer 14 for controlling the quality of the yarn F can be placed before the cylinders 11/12. The thread F thus produced enters into the collection unit 3, passes by a sensor 15 of the presence of thread and meets a compensator 16 for compensating the variations in length of the path between the spinning unit 2 and the deposit point of the yarn F on the cone. The thread-guiding device 21 distributes the thread on the cone in formation moving transversally with to and fro motion according to the double arrow b, actuated by a motor 20 that commands a longitudinal shaft 22 in common with the other units of the spinning machine. The cone 25 collects the thread F and is held by the cone-holding arm 26 equipped with two idle tailstocks 27 that can be opened that go into engagement with the basic quill 28 of the cone. The cone in formation 25 is rested upon its actuation roller or collection cylinder 29.

Recently conceived automatic open-end spinning machines are equipped with service trolleys that patrol the sides of the spinning machine and carry out the required interventions stopping in front of the spinning unit that requires it.

The required interventions are essentially of three types:

- for starting, at the beginning of the spinning from a still spinning machine, starting it and then placing a new quill in each station, carrying out the start-up with an auxiliary thread and winding the thread produced on the new quill to give a cone, after having eliminated that portion of auxiliary thread;
- for reattachment, when the yarn is interrupted for whatever reason, without having yet reached the length foreseen for completing the cone, using the yarn already produced by the side of the cone, carrying out the reattachment and continuing the winding on the same cone. The reattachment procedure essentially consists of the opening, cleaning and closing of the rotor, the preparation of the tail of the rove, the capturing and preparation of the end at the side of the cone, the restarting of the rotor and the continuation of the supply, the re-introduction into the rotor of the prepared end, the re-extraction of the end connected to the newly produced thread winding it once again in the collection unit. The programmed cleaning cycle is the equivalent to the reattachment cycle, caused with a commanded breaking of the thread;
- for lifting, after having reached the foreseen length for the cone to be complete. The finished cone is discharged and then one proceeds to starting the unit as outlined above.

Generally, such interventions are carried out by separating the cone 25 from its actuation cylinder 29, stopping its motion and actuating the cone 25 or its quill 28 by an auxiliary actuation roller arranged on-board the service trolley.

(2) Description of Related Art

In the field of devices and procedures for the intervention of service trolleys on automated open end spinning machines the applicant is the owner, amongst others, of patents IT 1.146.694, EP 340.863, EP 443.220, EP 473.212, IT 1.258.220, IT 1.258.221, IT 1.258.222.

In general, the automation trolley consists of a structure mobile along the sides of the machine, a communication system with the central control unit of the spinning machine and with the spinning unit that make up the machine, a translation and stopping system of the trolley in front of the units that require intervention. The mobile structure carries on-board members or groups of members dedicated to single or multiple operations of the various cycles that can at various times be required. Such members of the trolley are managed by the trolley's own control unit, which in turn communicates with the central control unit of the spinning machine and with the individual spinning stations.

In open-end spinning machines that are currently available the automation trolley, faced with a failed reattachment or lifting cycle, repeats the operating sequence of the cycle from the beginning for a certain number of times, in general not more than three so as not to compromise the overall efficiency of the spinning machine.

The spinning unit, after said failed attempts of the trolley, is left out of order (with a red light). The trolley is then advantageously diverted to be used for servicing other spinning units that require it.

On the trolley with a red light, the operator takes care of an inspection to identify the cause of the negative outcome of the previous automatic intervention and to take steps to prepare it for a further intervention, again to be conducted automatically, this time with a positive outcome.

In trolleys in use up to now on open-end spinning machines groups of members are arranged that are dedicated to single or multiple operations in the starting, reattachment, lifting and cleaning cycles of the spinning units.

In general such groups are—at least for the most part—mechanically interconnected, because they are equipped with cam actuation, and even if they are equipped with thread control and position sensors, they must necessarily operate in sequence. The various groups of members on-board the trolley carry out the various steps foreseen in sequence: they recover the end of the thread, they pass it from one to the next carrying out their job until the reattachment or the lifting is obtained on the spinning unit on which they intervene. At most, such automation trolleys allow—just for groups with autonomous actuation—their individual step to be lengthened or repeated until it has positively been completed.

It is clear that the failure of one of the steps of the cycle has the consequence of the failure of the entire cycle.

With the evolution of open-end spinning machine technology, the range of counts, of yarns and of fibres to be worked has substantially widened, whereas the quality specifications of yarn have become more stringent. With the overall cycles relative to reattachment and lifting in which a substantial number of members or groups of members on-board the trolley cooperate, its efficiency, in other words the successful completion of the operation without carrying out many attempts over and again, is very important. The coordination of said members is therefore very important for controlling them as regards relative positions, time and speed phasing of such members both in relation to each other and with respect to the thread that is adopted, manipulated and exchanged by said members, controlling the successful completion of each step of the process.

BRIEF SUMMARY OF THE INVENTION

The present invention is relative to a service trolley for open-end spinning machines, in which the individual operating steps in the cycles of the trolley are controlled one by one so that, in the case of failure of one of the steps, the trolley does not waste time pointlessly continuing with the sequence, but can restart the cycle from the unsuccessful step to repeat it, possibly with different operating parameters.

The purpose of the present invention is that of making a service trolley for open-end spinning machines that overcomes the described drawbacks of trolleys available in the state of the art and allows greater efficiency of the interventions and greater yield of the spinning machine to be obtained, reducing the idle time due to the repetition of interventions on spinning units.

In the trolley according to the invention the steps of the reattachment and lifting cycles are made independent from each other, so as to operate not according to a sequence of predetermined steps and times, but according to the needs that manifest themselves while the steps are being carried out.

To better highlight the problems tackled and the technical solutions proposed with the present invention we thus refer, in the following description, to a scheme of a trolley according to the invention in which the groups that carry out the cycles of the service interventions of an open-end spinning machine are inserted, as a non-limiting example.

The trolley device according to the invention is defined, in its essential components, in the first claim whereas its variants and preferred embodiments are specified and defined in the dependent claims.

In the trolley according to the invention each group dedicated to the steps of the intervention cycle is independent from the others, in other words is equipped with independent actuation—by a motor or by a pneumatic piston with speed and position respectively controlled through encoders or end stop probes—and is equipped with sensors for checking whether or not thread is present in the predetermined position for the various steps.

To carry out the present invention the motors for the moving of the service members of the trolley can be brushless motors that are driven in frequency so as to obtain angular positions, speeds and accelerations that are controlled in each step of their operations in the two directions of rotation.

DETAILED DESCRIPTION OF THE INVENTION

According to a preferred embodiment of the present invention the motors for the moving of the service members of the trolley are stepper motors driven in steps, again to obtain angular positions, speeds and accelerations that are controlled in each step of their operations in the two directions of rotation.

Figure 1:
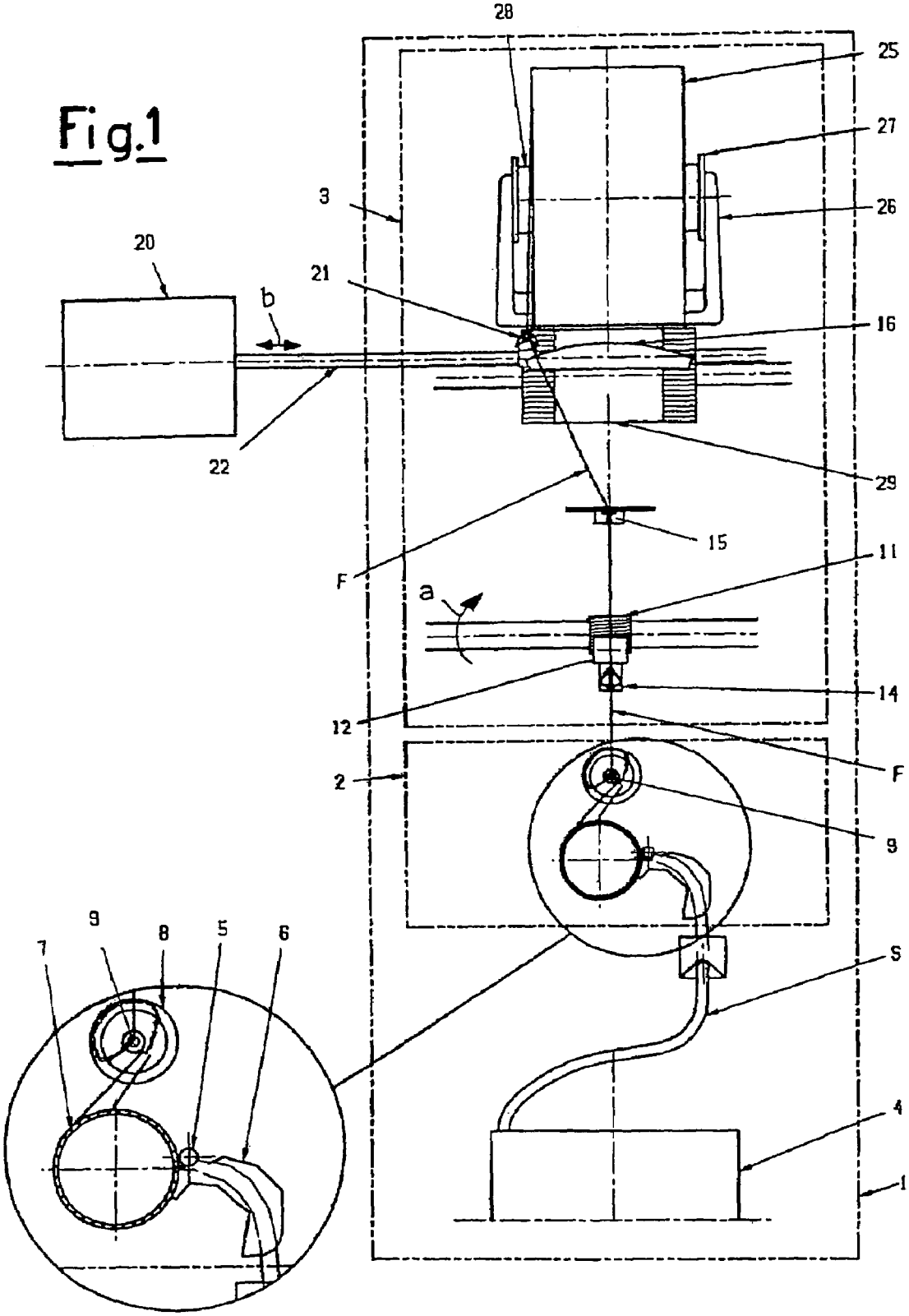
FIG. 1 illustrates the scheme of an open-end spinning station in its most significant components.
Figure 2:
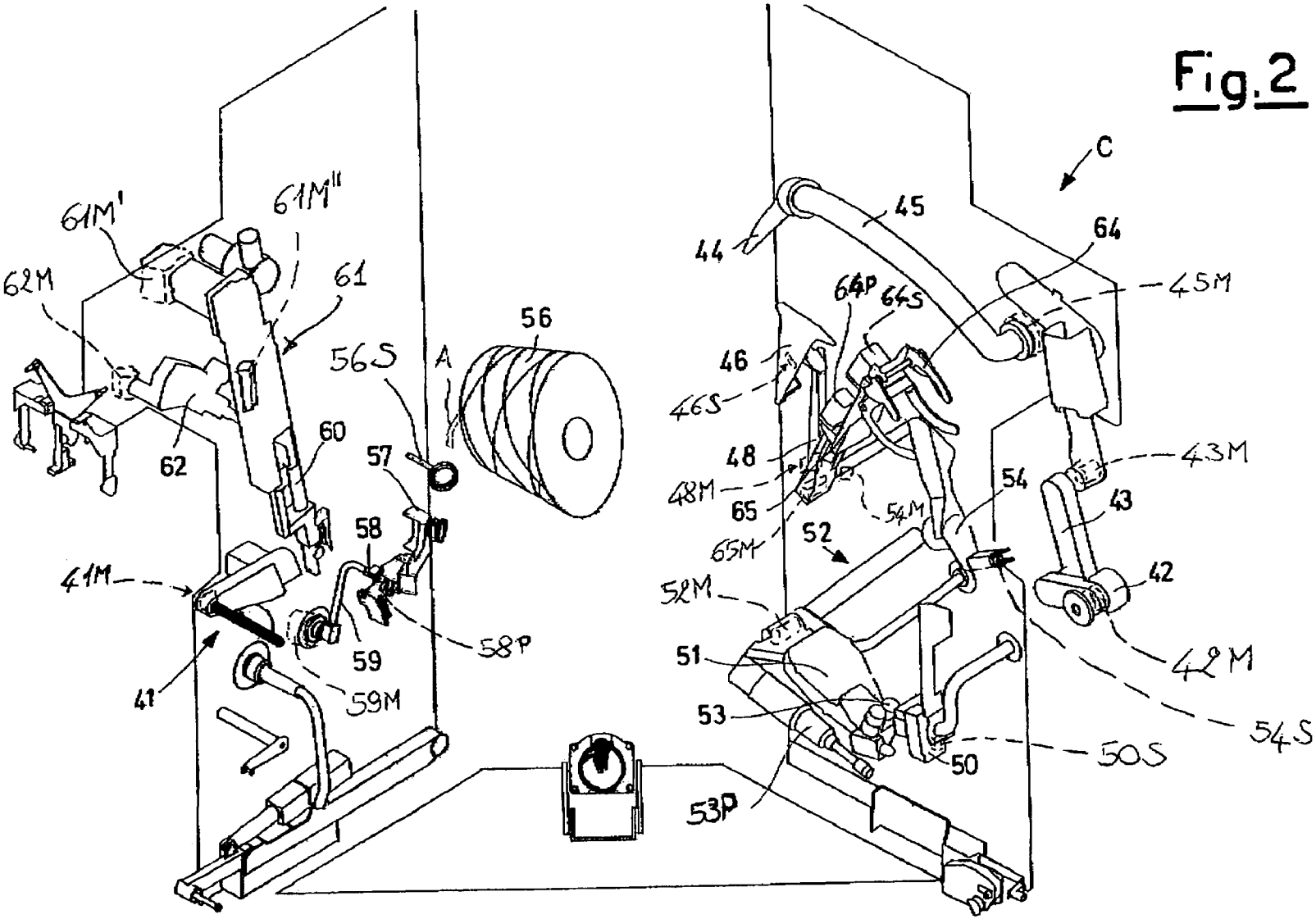
FIG. 2 shows an exploded view of the parallelepiped space inside the trolley C, in which the most significant members or groups that intervene in the servicing of the spinning units are schematically indicated, made according to the present invention.

In the trolley C illustrated in the scheme of FIG. 2 its most significant members or groups for servicing the open-end spinning unit, for both the reattachment and lifting operation, are shown:

- a device 41 for controlling and positioning the thread F during the intervention cycles that acts, during the intervention cycles, to lift and determine the level and the position of the thread connected with the cone or with its quill with respect to other members of the trolley. The device 41 is moved in rotation with a motor 41M. The position taken up by the device 41 is controlled by an absolute encoder, i.e. a member for detecting the angular position of the motor;

an auxiliary actuation roller 42 of the cone 25 or of the new quill 28, according to a clockwise/anti-clockwise rotation, during the service interventions. It can be moved forwards/backwards so as to be closer/further away with rotation of its arm 43 about a horizontal axis parallel to the front of the spinning machine, for example with a motor 43M. The angular position taken up by the arm 43 is also controlled by an absolute encoder. The rotation of the arm 43 is also used to discharge the finished cone pushing it towards the middle plane between the sides of the spinning machine. The auxiliary roller 42 is equipped with an actuation motor 42M capable of making the roller 42 rotate in commanded rotation in the two directions and controlled as far as speed and angular position are concerned, according to the drive that is imparted by the trolley control unit, which coordinates the operation of the various parts on-board the trolley itself with that of the spinning unit during the intervention cycles. According to a preferred embodiment of the present invention the motor 42M is a stepper motor driven to obtain angular positions, speeds and accelerations that are controlled in every step of its operation, in the two directions of rotation. Such driving is worked out also according to the diameter of the cone 25 on which the roller 42 operates;

a mobile suction mouth 44 for capturing the end of the thread on the side of the cone 25. It can be moved forwards/backwards so as to be closer/further away with rotation of its arm 45 about a horizontal axis parallel to the front of the spinning machine, for example actuated with a motor 45M, which works with the control of an absolute encoder;

a centraliser device 46, consisting of an engagement and displacement fork of the thread captured by the mouth 44. It is equipped with an optical sensor 46S of the presence of thread inside of it and can be raised/lowered with rotation of its arm 48 about a horizontal axis parallel to the front of the spinning machine to serve the subsequent preparing group.

More details on its structure and operation are described in patent EP 473.212.

The arm 48, for example, is also actuated with a motor 48M, which works with the control of an encoder. The sensor 46S of the presence of thread is preferably an optical sensor and firstly detects that the thread F has passed from the mouth 44 to the centraliser itself and then it detects that the thread has been taken into the exchange position with the subsequent preparing group;

a group 50 for preparing the end of the thread, mounted in a fixed position, which receives the thread from the centraliser 46, takes it, cuts it to size and prepares it for its re-introduction into the opening 9 of the spinning rotor 8. More details on its structure and operation are described in patent EP 443.220. The preparer 50 is also equipped with a sensor 50S of the presence of thread, which must detect the presence of thread after the preparation of the end before it is delivered to the subsequent introducing group;

an introducing group 51 for gripping the end of the thread F prepared by the preparing group 50 and for supplying it to the spinning rotor 8 for the spinning to start up again. The introducing group also works in the lifting cycle operating on the auxiliary thread. It moves according to a trajectory from the preparing group 50 to the opening 9 to present the end of the thread to the rotor 8, which in rotation exerts a substantial sucking action. The introducing group 51 comprises a moving structure 52, for example with a pantograph, capable of taking its gripping member 53 from an inactive (or rest) position and putting it in various working positions to take, grip, pull, release and deliver the thread from/to the various members of the trolley and of the spinning machines described up to now. The moving of the pantograph is, for example, actuated with a motor 52M, which works under the control of an absolute encoder to know the angular position taken up by the pantograph to take the gripping member 53 into the positions in which it must take and/or release the thread F or the auxiliary thread A. The gripping member 53 consists of a pair of elements that are opened or closed with a pneumatic cylinder 53P counteracted by a spring, to cause their opening when the thread to be gripped between them must be introduced or when the thread gripped previously must be released, then leaving them normally closed due to the force exerted by the spring;

a group 54 for lifting and opening the cone-holding arm 26, currently known as a "cone lifter", which disengages the cone from its roller 29 at the start and releases it at the end of each intervention cycle. The actuation open and closed of the tailstocks 27 allows—in lifting operations—the discharge of the finished cone and the insertion of a new quill 28, gripping the thread F between its base and tailstock 27.

The cone-lifting group 54 is actuated with a motor 54M, with the control of an absolute encoder to know the angular position of the cone-holding arm 26. It is also equipped with a proximity sensor 54S that carries out multiple controls and functions.

In the lifting cycle the proximity sensor 54S detects whether the arm 26 has been hooked with contact between cone lifter and arm; with contact carried out, it detects with its absolute encoder that the cone has the predetermined diameter (besides tolerances); it then detects, again with the encoder, that the arm is correctly raised with the cone. In the reattachment cycle, the sensor 54S is used to detect the diameter of the cone; based upon this detection the control unit of the trolley determines the duration both of the inversion of the motion of the cone with the auxiliary roller 42 and of the suction with the mouth 44, the size of the movement to lift the arm 26 to have a constant detachment of the cone 25 from its actuation cylinder 29 is also determined.

As well as these groups, for the lifting and starting operations the following are foreseen:

a cone 56 of auxiliary thread A that is used to start spinning, in start-up or in lifting, with the tautening transmission 57 and the pincer 58 that has the auxiliary thread A. The pincer 58 is able to intersect both the trajectory followed by the introducing group 52 and that of the following gripping member 60, which can therefore take and control the auxiliary thread, take it to the preparer 50 and then go to introduce it to the spinning rotor 8 to carry out a reattachment of the auxiliary thread to the new thread in production.

For such a purpose the pincer 58 is mounted on a motorised arm 59 that rotates in the plane of the figure and carries the auxiliary thread to be gripped by said manipulation members. In the same way as the member 53, the pincer 58 is opened and closed with a pneumatic cylinder 58P counteracted by a spring, to cause it to open and close. The arm 59 is moved by a motor 59M, with the control of an absolute encoder to know its angular position. Downstream of the pincer 58 there are scissors that, when the auxiliary thread A has been presented and gripped by such members, cut the thread leaving its end upstream still in the pincer 58, ready for it to be subsequently taken. An optical sensor 56S is arranged in the path of the thread A coming from the auxiliary cone 56 and at the pincer 58 intended to detect:

- the presence of thread on the auxiliary cone, i.e. that it has not run out or that the thread has not broken before the sensor,
- that the auxiliary thread A is correctly picked up by the introducer 51 and taken to the preparer 50, since in transportation the thread A runs inside the sensor,
- that the gripping member 60 has taken the thread A unwinding it from the cone 56, again since in transportation the thread A runs inside the sensor;
- a hooked gripping member 60 with suction mouth for capturing, moving and centring both the auxiliary thread and the initial new thread, to present it both to the reattachment members of the auxiliary thread during the lifting cycle and to grip the new thread between quill 28 and tailstock 27.

Such a hook with mouth 60 is equipped with a V-shaped centrer and is mounted on an arm 61 that can be extended and rotated about a horizontal axis parallel to the front of the spinning machine. Such moving of the arm 61 is actuated with a motor 61M' as far as the extension motion is concerned and a motor 61M" as far as the rotation motion is concerned. The two movements are always detected with the encoders connected to the two motors;

- a device 62 for depositing and binding an initial reserve of thread at the end of the new quill 28. More details on its structure and operation are described in patent EP 340.863. The device 62 is also moved with a motor 62M equipped with an encoder;
- a quill-holding group 64, which carries the new quill 28 picking it up from a conveyor belt arranged above the front of the machine and presenting it to the tailstocks 27 of the cone-carrying arm 26, opened by the cone-lifting group 54. Such a quill-holding group comprises a sort of set of many opposite horizontal rollers that allows the rotation of the quill about its axis rolling between the rollers. The set is opened and closed by actuation with a double-action piston 64P equipped with end stop probes. The quill-holding group 64 can be moved towards/away from the gripping position to the delivery position with rotation of its arm 65 about a horizontal axis parallel to the front of the spinning machine, for example actuated with a motor 65M, which works with the control of an absolute encoder.

A proximity sensor 64S is arranged on the quill-holding group to detect the presence or absence of the quill in the set. Before taking the quill and leaving it detects whether the quill on the conveyor belt mentioned previously has arrived from the trolley by the lifting operation and, before going back into rest position at the end of the cycle, it detects whether the delivery set of the quill to the cone-holding arm is empty, having correctly handed it over to the grip of the tailstocks 27, or else whether it still has the quill 28 on-board.

During the intervention cycles carried out by the trolley, the control unit of the trolley operates connected also to the control unit of the spinning unit and receives the signal detected with the sensor 15 of the presence of thread arranged at the start of the path of the thread in the collection unit preceding the compensator 16. This sensor is preferably an optical sensor and is also used in the intervention cycles to detect:

- the successful transportation by the introducing group 51 of the end of the prepared thread F in the introduction position in the opening 9 of the rotor 8 (static reading), and
- the successful reattachment and restarting of the collection with the thread F that runs in the sensor (dynamic reading).

The automatic service trolley of open-end spinning machines according to the invention carries out its function with greater speed and flexibility in intervention cycles of the service trolley of an open-end spinning machine and has substantial advantages with respect to known devices.

The trolley according to the invention is able to detect, with the control unit that manages it, the following parameters:

- the correct position, configuration and speed of each group of the trolley,
- the presence of manipulated thread, in the right position, on the group that at that moment receives it,
- the successful exchange of manipulated thread between the group that has it in delivery and the next one,
- the successful exchange of manipulated thread between the groups of the trolley, the spinning unit and the collection unit,
- the correct diameter of the cone to be lifted,
- the successful reattachment or lifting.

The structure of the trolley according to the invention allows its control unit to know in real time whether each step of the intervention has been carried out correctly and with a good outcome. It allows—in the case of incorrect execution—the previous step or steps to be repeated, possibly also with different adjustments to have greater probability of success. There is also the possibility of restarting the cycle from a point of the cycle upstream so as to ensure the control of the thread to be manipulated. In any case, a substantial saving of time, thread and energy is obtained.

The trolley device according to the invention also allows a cone with a diameter outside of the predetermined tolerances of the length/diameter ratio to be left on the collection unit and be treated separately, thus avoiding mechanical and pollution problems of the batch of cones with cones having a density outside specifications.

The invention claimed is:

1. Service trolley for open-end spinning machines equipped with members or groups of members dedicated to single or multiple operations in the intervention cycles on spinning stations, such members of the trolley being managed by the trolley's own control unit, characterized in that each member or group dedicated to the steps of the intervention cycle is independent from the others, and is equipped with independent and controlled actuation as well as with sensors for checking whether or not the thread is present in the predetermined position for the various steps.

2. Service trolley for open-end spinning machines according to claim 1, characterized in that the actuation of the members or of the groups dedicated to the steps of the intervention cycle is carried out with a motor or with a pneumatic piston, whereas their speed and position control is carried out with an encoder and/or with end stop probes.

3. Service trolley for open-end spinning machines according to claim 2, characterized in that the actuation of the members or of the groups dedicated to the steps of the intervention cycle is carried out with brushless motors driven in frequency to obtain angular positions, speeds and accelerations that are controlled in every step of their operation, in the two directions of rotation.

4. Service trolley for open-end spinning machines according to claim 2, characterized in that the actuation of the members or of the groups dedicated to the steps of the intervention cycle is carried out with stepper motors driven in steps to obtain angular positions, speeds and accelerations that are controlled in every step of their operation, in the two directions of rotation.

5. Service trolley for open-end spinning machines according to claim 3 or 4, characterized in that the control of speed and position of the members or of the groups dedicated to the steps of the intervention cycle is carried out with absolute encoders, that is a member for detecting the angular position of their actuation motor.

6. Service trolley for open-end spinning machines according to claim 3 or 4, characterized in that the actuation of the members or of the groups dedicated to the steps of the intervention cycle is carried out with the driving of the motors, as far as speed and angular position are concerned, according to the driving that is imparted by the control unit of the trolley, which coordinates the operation of the various parts on-board the trolley itself with that of the spinning unit during the intervention cycles.

7. Service trolley for open-end spinning machines according to claim 3 or 4, characterized in that it comprises the following members or groups of members: positioning device (41) of the thread connected with the cone (25) or with the quill (28), auxiliary actuation roller (42) of the cone, mobile mouth (44) for capturing the end, centraliser (46) of the thread (F), fixed preparer (50) of the end of the thread, introducing group (51) of the end at the rotor (8), cone-lifting group (54) of the cone-holding arm (26), cone (56) of auxiliary thread (A) with presenting pincer (58), gripping member (60) of the thread with a hook and opening, binding device (62) of the initial reserve of thread on the quill, quill-holding group (64).

8. Service trolley for open-end spinning machines according to claim 7, characterized in that it comprises the following control sensors: sensor of the thread (46S) on the centraliser (46), sensor of the thread (50S) on the preparing group (50), proximity sensor (54S) for detecting the position of the cone-holding arm (26), sensor of the thread (56S) on the auxiliary cone (56), proximity sensor (64S) for detecting the quill on the quill-holder (64) and that it is in connection with the sensor (15) of the presence of thread arranged at the start of the path in the collection unit (3) of the spinning station.

* * * * *